US011785675B2

(12) United States Patent
Gagnon

(10) Patent No.: US 11,785,675 B2
(45) Date of Patent: Oct. 10, 2023

(54) SURFACE HEATING ASSEMBLY AND RELATED METHODS

(71) Applicant: Schluter Systems L.P., Plattsburgh, NY (US)

(72) Inventor: Gilles Gagnon, Plattsburgh, NY (US)

(73) Assignee: Schluter Systems L.P., Plattsburgh, NY (US)

( * ) Notice: Subject to any disclaimer, the term of this patent is extended or adjusted under 35 U.S.C. 154(b) by 961 days.

(21) Appl. No.: 16/555,876

(22) Filed: Aug. 29, 2019

(65) Prior Publication Data

US 2020/0092954 A1 Mar. 19, 2020

Related U.S. Application Data

(60) Provisional application No. 62/726,268, filed on Sep. 2, 2018.

(51) Int. Cl.

| | |
|---|---|
| ***H01B 13/00*** | (2006.01) |
| ***H01B 13/14*** | (2006.01) |
| ***H05B 3/56*** | (2006.01) |
| ***H01B 7/02*** | (2006.01) |
| ***H01B 13/24*** | (2006.01) |

(52) U.S. Cl.

CPC ..... *H05B 3/56* (2013.01); *H01B 7/0275* (2013.01); *H01B 13/0023* (2013.01);

(Continued)

(58) Field of Classification Search

CPC ..... H05B 3/56; H05B 2203/009; H05B 2203/01; H01B 13/0023; H01B 13/146;

(Continued)

(56) References Cited

U.S. PATENT DOCUMENTS 3,657,520 A 4/1972 Ragault
4,185,186 A 1/1980 Williams (Continued)

FOREIGN PATENT DOCUMENTS

CN 101909373 A 12/2010
CN 201754628 U 3/2011

(Continued)

OTHER PUBLICATIONS

Suzuki et al., "Development of cold-shrinkable joints with carrier pipes for EHV cables," 2000 Power Engineering Society Summer Meeting (Cat. No. 00CH37134), Seattle, WA, 2000, pp. 469-474 vol. 1. (Year: 2000).*

*Primary Examiner* — A. Dexter Tugbang
(74) *Attorney, Agent, or Firm* — Jason Jones

(57) ABSTRACT

A method of forming a plurality of individual heating cables sets includes creating at least a portion of a master cable set by coupling alternating sections of cold and hot cable section, each section of cold cable section having a length twice a model cold cable section length and each section of hot cable section having a length twice a model hot cable section length. A continuous metallic ground sheath is applied about substantially all of the master cable set and a continuous outer jacket is applied about the continuous metallic ground sheath. The master cable set is segmented at defined locations to create a plurality of individual heating cable sets having an overall length of the model hot cable section length plus the model cold cable section length.

12 Claims, 4 Drawing Sheets

(52) U.S. Cl.
CPC ..... *H01B 13/146* (2013.01); *H01B 13/245* (2013.01); *H05B 2203/009* (2013.01); *H05B 2203/01* (2013.01); *H05B 2203/026* (2013.01)

(58) Field of Classification Search
CPC ..... H01B 7/0275; H01B 13/245; H01B 2203/026
See application file for complete search history.

(56) References Cited

U.S. PATENT DOCUMENTS

| | | | | |
|---|---|---|---|---|
| 4,407,065 | A * | 10/1983 | Gray | H05B 3/56 228/130 |
| 4,518,445 | A | 5/1985 | Pedersen et al. | |
| 4,641,525 | A * | 2/1987 | Merki | H01B 13/146 324/226 |
| 6,294,768 | B1 | 9/2001 | Liebich | |
| 6,303,905 | B1 | 10/2001 | Chiles et al. | |
| 6,976,308 | B2 | 12/2005 | Jonli | |
| 7,180,040 | B2 | 2/2007 | Jones | |
| 7,326,881 | B2 | 2/2008 | Jones | |
| 8,455,795 | B2 | 6/2013 | Charron | |
| 2008/0047946 | A1 | 2/2008 | Van Klompenberg et al. | |
| 2017/0016565 | A1* | 1/2017 | Tkaczyk | H05B 3/56 |

FOREIGN PATENT DOCUMENTS

| | | | |
|---|---|---|---|
| CN | 103813491 | A | 5/2014 |
| EP | 0858245 | A2 | 8/1998 |
| JP | 2010067575 | A * | 3/2010 |

* cited by examiner

SURFACE HEATING ASSEMBLY AND RELATED METHODS

PRIORITY CLAIM

Priority is claimed of and to U.S. Patent Application Ser. No. 62/726,268, filed Sep. 2, 2018, which is hereby incorporated herein by reference in its entirety.

BACKGROUND OF THE INVENTION

Field of the Invention

The present invention relates generally to heating cable sets. More particularly, the present technology relates to electrical floor heating systems installed beneath floor covering applications, such as ceramic tiles, stone, wood, etc.

Related Art

Electrical heating cable sets can be installed beneath traditional flooring applications to warm the floor from beneath. In most such installations, the heating cable set includes a hot cable section, or a hot lead, that forms the hot section of the heating cable set, or the heating cable section, that is installed beneath the floor. Heat is generated as current flows through conductors of the hot cable section. A cold cable section, or a cold lead, is generally connected between a thermostat and the heating cable section to form a heating cable set. The cold lead is generally run within a wall or similar structure. As such, it provides current to the hot lead but does not itself significantly increase in temperature during operation.

The heating cable section is generally buried beneath the floor covering materials, where it is desired to create heat, while the cold cable section is generally hidden behind materials or structure, where it is not desired to create heat (e.g., within wall cavities). The location at which the heating cable section and the cold cable section are joined together is therefore generally located within the flooring installation, as the heating cable section should not extend beyond the flooring installation. The splicing of the heating cable section and cold cable section at this location often results in a joint that is much bulkier than either the heating cable section or the cold cable section (see, for example, FIG. 1 herein). Installers typically bury this joint beneath tiles and mortar very near an edge of the floor covering installation. Due to the size of the joint, it is sometimes required of the installer to gouge a hole within the subfloor material to ensure that the joint is low enough to not interfere with the floor covering installation. For applications where a membrane is installed under the heating cable sets for the purpose of waterproofing the subfloor, and possibly for uncoupling purposes with the floor covering material, the membrane will also need to be cut to lower the position of the joint. In these cases, a sealant needs to be applied around the joint and on the membrane to render it waterproof again at that location.

Thus, while in-floor heating cable sets have been, and continue to be, used with success, efforts continue to seek a jointing process that minimizes the impact the joint between the heating cable section and cold cable section has on the flooring installation.

SUMMARY OF THE INVENTION

In accordance with one aspect of the invention, a method of forming a plurality of individual heating cable sets is provided. The method can include creating at least a portion of a master cable set by: obtaining a first segment of cold cable section having a length twice a model cold cable section length; obtaining a first segment of hot cable section having a length twice a model hot cable section length; coupling the first segment of hot cable section to the first segment of cold cable section; obtaining a second segment of cold cable section having a length twice the model cold cable section length; coupling the second segment of cold cable section to the first segment of hot cable section; obtaining a second segment of hot cable section having a length twice the model hot cable section length; and coupling the second segment of hot cable section to the second segment of cold cable section; and so on, by repeating additional steps as above. The method can include applying a continuous ground braid, or other metallic sheath, about substantially all of the master cable set; and applying a continuous outer jacket about the continuous ground braid, or other metallic sheath. The master cable set can be segmented at defined locations to create a plurality of individual heating cable sets having an overall length of the model hot cable section length plus the model cold cable section length.

In accordance with another aspect of the invention, a method of forming a heating cable set is provided. The method can include obtaining a hot conductor having an outside diameter and a model hot conductor length and installing a hot conductor insulation having an outside diameter about the hot conductor. The method can include obtaining a cold conductor having an outside diameter and a model cold conductor length and installing a cold conductor insulation having an outside diameter about the cold conductor. The method can include varying at least one of: i) the outside diameter of the hot conductor; ii) the outside diameter of the hot conductor insulation; iii) the outside diameter of the cold conductor; and iv) the outside diameter of the cold conductor insulation in order to achieve a difference between the outside diameter of the hot conductor insulation and the outside diameter of the cold conductor insulation that is within a predetermined target range. The at least one hot conductor can be coupled to the at least one cold conductor to form a heating cable set having a finished length of the hot conductor model length plus the cold conductor model length.

In accordance with another aspect of the invention, a continuous heating cable set assembly is provided, including a first length of cold cable section having a length twice a model cold cable section length. A first length of hot cable section can have a length twice a model hot cable section length, the first length of hot cable section being welded to the first length of cold cable section. A second length of cold cable section can have a length twice the model cold cable section length, the second length of cold cable section being welded to the first length of hot cable section. A second length of hot cable section having a length twice the model hot cable section length, the second length of hot cable section being welded to the second length of cold cable section, and so on, by repeating additional steps as above. A continuous ground braid can be applied about a cumulative length of the hot cable sections and cold cable sections. A continuous outer jacket can be applied about the continuous ground braid, or other metallic sheath.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
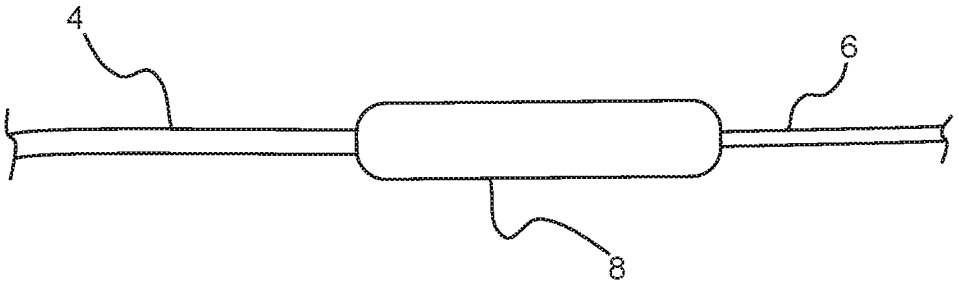
FIG. 1 is a portion of a PRIOR ART underfloor heating cable set.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a conductor" can include one or more of such conductors, if the context so dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

The terms "hot cable section" and "cold cable section" are used herein to describe sections of a heating cable set. Generally, these are sections of a cable set on opposing sides of a joint or weld. It is understood that the specific components of a hot or cold cable section can vary, depending upon the point in time of manufacture of the hot or cold heating cable sections. For example, a finished hot cable section may include one or more insulated conductors covered by a metallic ground sheath covered by an outer jacket. However, during early stages of processing or formation of the hot cable section, it may contain fewer of those components, as the remaining components may not yet have been installed or attached. For example, when reference is made to "forming" a cable section, this can include forming only a portion of a completed cable section. When differentiation between the two is prudent, a cable section can be referenced as a "completed cable section," when it includes all components it will include, or "a partial cable section," when it does not yet include all components that it will include.

As used herein, the term "continuous" is sometimes used to refer to a component or structure that is applied about one or more other components as an integral, complete and unbroken piece. A component that is applied as a "continuous" unit can include a material having no discontinuities, breaks or other sections lacking material from which the component is formed. As one example, a ground braid is sometimes applied herein over other conductor segments: while a ground braid may include discontinuities in the material from which the braid is formed (e.g., openings or spaces between wires of the braid), when the ground braid is applied as a continuous unit, the same piece or unit of such material is applied without interruption, even if small holes or openings otherwise appear throughout the continuous piece of material.

The term "conductor" is used herein to refer to electrically conductive materials. In some cases, a conductor is comprised of a single, solid piece of metal (for example, a conductor that is commonly referred to as a solid wire conductor). In other cases, a conductor can include a single conductor formed of many smaller conductors twisted into a single unit (for example, a conductor commonly referred to as a stranded wire conductor). As those terms are used herein, either or both a "hot" or "cold" "cable section" can include a single insulated conductor (either solid or stranded), or can include two or more insulated conductors twisted into a cable section (or run parallel to one another as a cable section). For example, while reference may be made to "a" hot cable section, it is to be understood that such a section may include one, two or more insulated conductors (solid or stranded) configured as a single conductor for use as a hot conductor herein.

Reference can be made herein to hot and cold conductors. This reference is not made with regard to whether or not a conductor is carrying current. The floor warming cables disclosed herein include two primary components: a "hot" cable section having one or more "hot" conductors which is configured to generate appreciable heat when subjected to a current, and a "cold" cable section having one or more cold conductors which is configured to exhibit very little, if any, appreciable warming when subjected to a current. These conductors are joined at a splice: on one side of the splice, as current is applied to the overall cable, the cold conductor carries current to and from the hot conductor but does not, itself, generate much heat. On the other side of the splice, the hot conductor, in contrast, generates appreciable heat when subjected to the current. Thus, a "cold" conductor, as that term is used herein, may very well be "live" that is, it may be carrying an electrical current even if it does not appreciably increase in temperature while carrying that current.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward,"

"downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. In some instances, dimensional information is included in the figures. This information is intended to be exemplary only, and not limiting. In some cases, the drawings are not to scale and such dimensional information may not be accurately translated throughout the figures.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to systems used beneath floor covering installations to warm the floor covering surface. While the present technology is not so limited, the discussion herein will focus primarily on the use of electric heating cable sets installed beneath ceramic tiles. The systems can be equally effective beneath wood floors, polymer floors, composite floors, etc. In such systems, membranes such as those commercially known as Schuter's DITRA-HEAT® can be secured to a subfloor, after which a heating cable set can be run in a generally repeating back-and-forth pattern and held within securing features of the membrane. Ceramic tiles can then be installed over the membrane and heating cable. As current is applied through the heating cable, the ceramic tiles are heated, creating a pleasantly warmed floor beneath a user's feet.

Such heating cable sets typically include two primary sections: a "cold" lead or cold cable section, and a "hot" lead or hot cable section. The hot lead is installed beneath the floor covering and the cold lead carries current to and from the hot lead. FIG. 1 illustrates an exemplary portion of a prior art heating cable, with cold lead or cold cable section 4, hot lead or hot cable section 6 and a joint or splice 8 therebetween. Oftentimes, cold lead 4 is larger in diameter than hot lead 6: as the hot lead is intended to generate appreciable heat when subjected to current, smaller conductors are generally used in the hot lead of prior art cables. As will be appreciated, the joint 8 presents a much larger profile than either the cold lead or the hot lead. This large profile joint can be difficult to install in a flooring application while not interfering with the required tolerances of such an installation. Some installers resort to gouging a depression in the subfloor and/or membrane to bury the joint below the flooring installation.

The present technology provides various systems and methods for creating a heating cable with minimal joint bulk. The present technology achieves this result without significantly departing from conventional materials and without significantly increasing the material requirements, cost or complexity of forming the cable.

Figure 2:
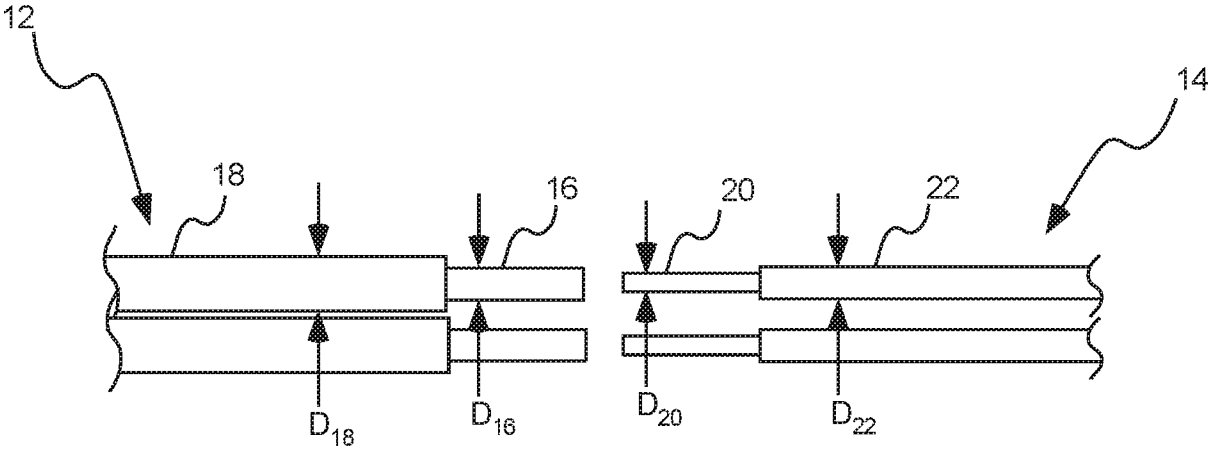
FIG. 2 illustrates portions of a number of conductors used in a heating cable set in accordance with an embodiment of the present invention.

FIG. 2 illustrates a series of conductors that can be joined to create a heating cable set. Cold lead or cold cable section 12 in this example includes two wires, each having a cold conductor 16 (having a diameter $D_{16}$), and a cold insulator 18 (having an outer diameter $D_{18}$). Hot lead or hot cable section 14 in this example includes two wires, each having a hot conductor 20 (having a diameter $D_{20}$), and a hot insulator 22 (having an outer diameter $D_{22}$). In this example, each of the hot and cold cable sections or leads includes two wires. In the interest of clarity, the following discussion can reference hot or cold cable sections as simply having "a" conductor, with the understanding that such conductor may include two or more individual wires that constitute the conductor.

Figure 3:
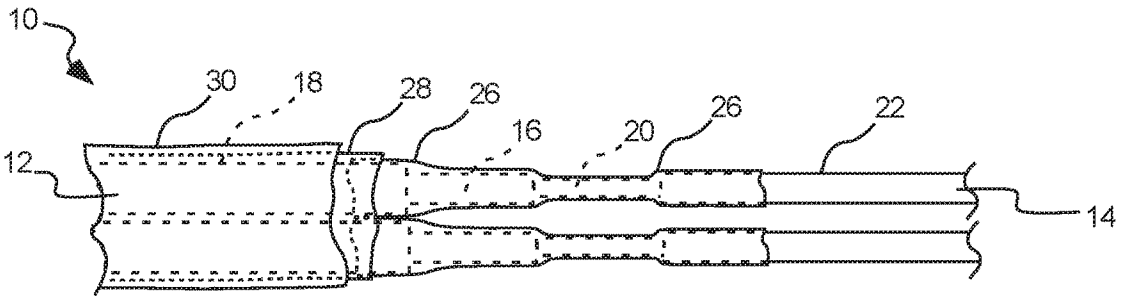
FIG. 3 illustrates the portions of conductors of FIG. 2 shown after further processing of the heating cable set.

FIG. 3 illustrates the cable sections 12, 14 after being coupled one to another to thereby form a heating cable set 10. In a typical application, the cable sections can be welded to one another, as is known in the art of wire coupling. While not so required, in one embodiment of the invention, the conductors of the cable sections are welded to one another by way of a silver alloy weld, or a similar welding technique that produces a low-profile joint. In addition to welding, various other coupling methods can be used, such as soldering, crimp wire terminals, etc.

After welding the conductors 16, 20 of the cable sections 12, 14 one to another, a local insulator 26 can be applied over the bare ends of the conductors and over the weld. The local insulator can be, for example, a shrink-tube insulator or similar technology. Optionally, after the bare conductors and weld joint are covered by insulator 26, a grounding jacket 28 can be applied over the entirety of the cable. In one embodiment, the grounding jacket can include a metallic ground sheath, such as a wire braid, applied by a conventional wire braiding machine. Advantageously, the present technology allows application of the wire braid or ground over the entirety of the cable, only nominally increasing the size of the weld joint (while also nominally increasing the outer diameter of the adjacent lead assemblies).

After application of the wire braid 28, an outer jacket or cover 30 can be applied along the entirety of the heating cable set 10. The outer jacket can take a variety of forms. In one example, it has been found that it is desirable to form the jacket using a PVC (polyvinyl chloride) compound or an ETFE (ethylene tetrafluoroethylene) material, which can, in certain applications, be applied using the tubing extrusion process in a continuous run. While the tubing extrusion process produces good results, and has been used for some time for applying the outer jacket on cable cores that contain few size discontinuities, the present inventor has found that attempting to use the tubing extrusion process for conventional heating cables on cable cores having large size differences has proved problematic.

Figure 4:
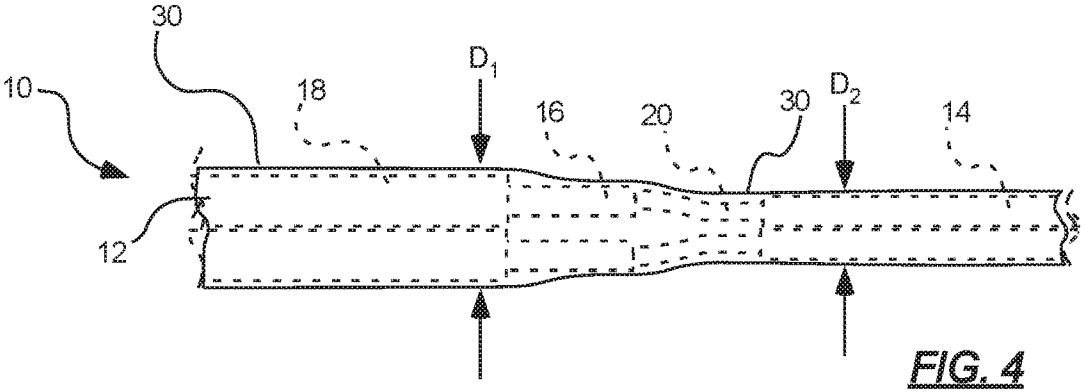
FIG. 4 illustrates a portion of a heating cable set in accordance with an embodiment of the present technology.

This issue is illustrated in more detail in FIG. 4. Note that some features of the heating cable set 10 are omitted from FIGS. 4 and 5 in the interest of clarity. As will be appreciated from FIG. 4, the diameter $D_1$ of the heating cable set on the cold lead 12 side of the joint is significantly larger than the diameter $D_2$ of the heating cable set on the hot lead 14 side of the joint. This discontinuity in size in the master cable set can create issues when applying the outer jacket 30 by way of a tubing extrusion process. Notably, the step-up and/or step-down in size when transitioning from hot-to-cold or cold-to-hot conductor along the master cable set can cause the extrusion cone to break during application, if the difference in sizes is too large. This same result can occur when a weld joint is significantly bulkier than the remaining conductors of a heating cable set.

The present technology addresses this issue in a variety of manners. In one aspect of the invention, the process can include varying at least one of: i) the outside diameter $D_{20}$ of the hot conductor 20; the outside diameter $D_{22}$ of the hot conductor insulation 22; the outside diameter $D_{16}$ of the cold conductor 16; and the outside diameter $D_{18}$ of the cold conductor insulation 18. One or more of these inputs can be varied to achieve a target range of diameter differential between the diameter of the cold conductor portion of the heating cable set 10 and the hot conductor portion of the heating cable set. In other words, by altering one or more of these inputs, the size discontinuity in the heating cable set, or master cable set, at the joint between the cold and hot leads can be eliminated or reduced to a value that is manageable by the extrusion process for applying the outer jacket (and, where applicable, the wire ground braid). The target range diameter differential can be expressed as a percentage of the difference between the two diameters. For example, assuming a particular diameter $D_1$ is larger than a particular diameter $D_2$, the differential can be expressed as $100\times(D_1-D_2)/D_1$. As this value approaches zero, the differential approaches zero. The larger this value, the greater the difference between the two diameters.

This target range can vary for the particular extrusion process being used. In one aspect of the invention, the target range can be about 7% or less for the pressure extrusion method, and about 20% or less for the tubing extrusion method. In another embodiment, the target range can be about 10% or less for the pressure extrusion method, and about 25% or less for the tubing extrusion method. In another embodiment, the target range can be about 5% or less for the pressure extrusion method, and about 15% or less for the tubing extrusion method.

Adjusting the various parameters discussed above can be achieved in a variety of manners. The alloy used in either or both the hot or cold conductor can be varied to achieve a larger or smaller conductor diameter. This adjustment can be made while ensuring that necessary operating ranges of the conductors are maintained (e.g., electrical resistance, current rating, etc.). A material type of the hot or cold insulator can also be varied such that a desired diameter is achieved, while also considering the insulative and mechanical properties of the material (e.g. voltage rating, toughness, minimum thickness, etc.).

In some cases, as the insulation material on either or both the cold or hot leads is relatively inexpensive, increasing the overall thickness of the insulator (and thus the outer diameter of the insulator) without changing the material type can be effective. This is the case in the example illustrated in FIG. 5. In this example, the diameter $D_1$ of heating cable set 10' is essentially the same as in the example of FIG. 4. That is, the diameter of the cold cable section 12 has not been modified. However, the thickness of hot insulator 22 has been increased significantly, leading to a larger overall diameter $D_{22}$. This larger diameter $D_{22}$ results in the overall diameter $D_3$ much more closely approximating diameter $D_1$. Thus, the diameter differential has been reduced significantly. This can be accomplished with little overall effect on the cost of the cable and no detrimental effect on the operational capability of the cable.

While the insulators shown in the figures are generally shown as a single material, it is to be understood that the insulators can include multiple layers of differing material and can be formed as composite materials. The outer diameter of the insulators can be adjusted by increasing a thickness of the insulators, or by installing another material, such as paper or cloth filling, between the conductors and the insulators, or both.

Figure 5:
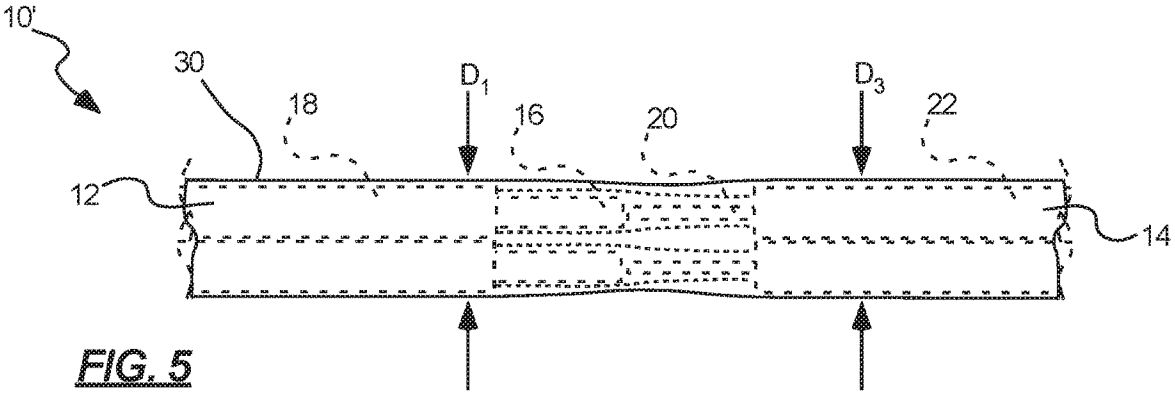
FIG. 5 illustrates a portion of a heating cable set in accordance with an embodiment of the present technology.

Note that the joints illustrated by example in FIGS. 3-5 generally appear smaller than the adjacent hot and cold leads (or at least the largest of the adjacent lead). In practice, this joint is likely slightly larger than the adjacent cables. This is due to the weld material, the local insulator, possible twisting or crimping of conductor ends, etc. This large joint profile has been problematic in prior art approaches. The present technology, while presenting a joint profile that is slightly larger than the largest adjacent lead, is still much smaller than those provided by the prior art.

In some embodiments, in the case where each of the heating cable section and the cold cable section have two or more conductors, each weld can be staggered (longitudinally along the length of the cable set) to obtain a joint with a lower overall diameter. For example, a first pair of hot and cold conductors can be coupled at a first longitudinal location along the cable, and a second pair of hot and cold conductors can be coupled at a second longitudinal location along the cable, the second longitudinal location being displaced some distance from the first longitudinal location. This displacement distance can be, for example, about 0.25 inch, about 0.5 inch, etc.

Figure 6:
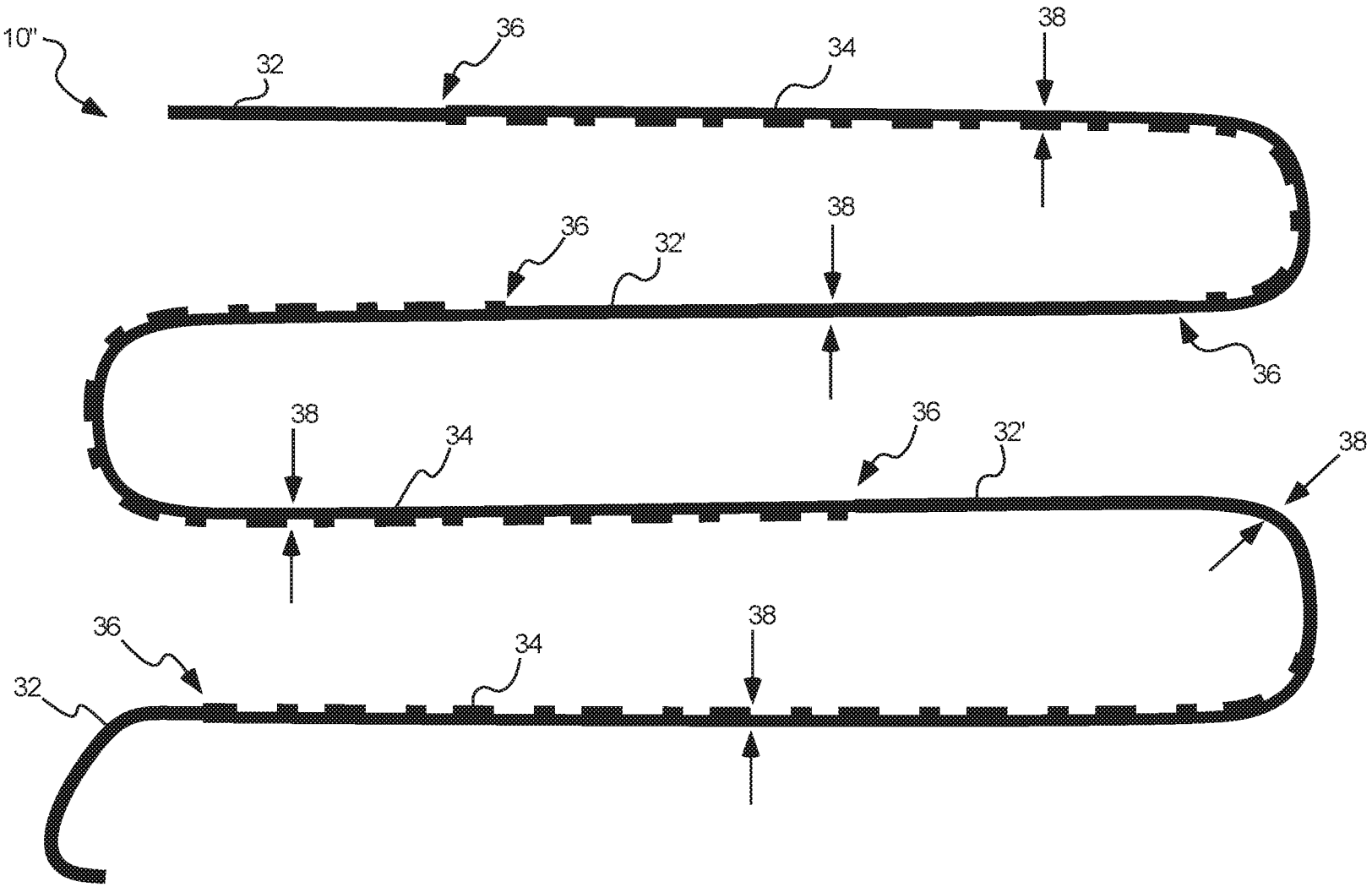
FIG. 6 illustrates a master heating cable set assembly prior to segmentation of the master heating cable set into individual heating cable sets in accordance with another embodiment of the present technology.

The advantages provided by the present technology allow the formation of long runs of master cable set (i.e. multiple numbers of heating cable sets) with a single, continuous ground braid and outer jacket application. One exemplary assembly achievable in this manner is shown in FIG. 6. Note that FIG. 6 illustrates different segments of the master cable set with different line types: these line types are not intended to convey physical properties of the cable, they merely visually indicate differences between cable sections.

In this example, a master cable set 10" has been formed that includes a series of segments or portions including cold lead or cable sections 32, cold lead or cable sections 32', and hot lead or cable sections 34. Joints 36 are formed between each hot lead section and cold lead section. Each cold lead section 32 is formed at a model cold cable section: that is, the length at which it will appear in the finished heating cable set. Each of the cold lead sections 32' is formed with a length of twice the model cold cable section length: that is, they are twice as long as is desired for the finished heating cable set. Similarly, each of the hot lead segments 34 are formed at a length twice as long as a model hot cable section length: that is, they are twice as long as is desired for the finished heating cable set.

Once formation of the master cable set is complete, the master cable set can be segmented into predetermined lengths. The master cable set 10" shown can be segmented at locations 38. It will thus be appreciated that the master cable set shown can be segmented into six individual heating cable sets, each individual heating cable set including a cold lead or cold cable section having the model cold lead or cable section length coupled to a hot lead or hot cable section having the model hot lead or cable section length. Once the individual heating cable sets are formed by segmenting the master cable set, ends of the hot lead can be finished by, for example, applying a splice to create a closed loop. Ends of the cold lead can be finished by, for example, stripping the insulator off portions of the conductor and otherwise preparing those ends for attachment to a thermostat or other controller.

Note that the segmentation locations 38 can be, in the example shown, located halfway along any particular segment 32', 34. Thus, as the master cable set 10" is segmented at these locations, the segments 32', 34 are segmented into two equal lengths (which correspond to the model length). The segmentation locations can, however, be varied as desired for any particular application. For example, it may be desirable to form the segments 32', 34 at lengths other than twice the model length, in which case the segmentation locations can be adjusted accordingly.

Figure 7:
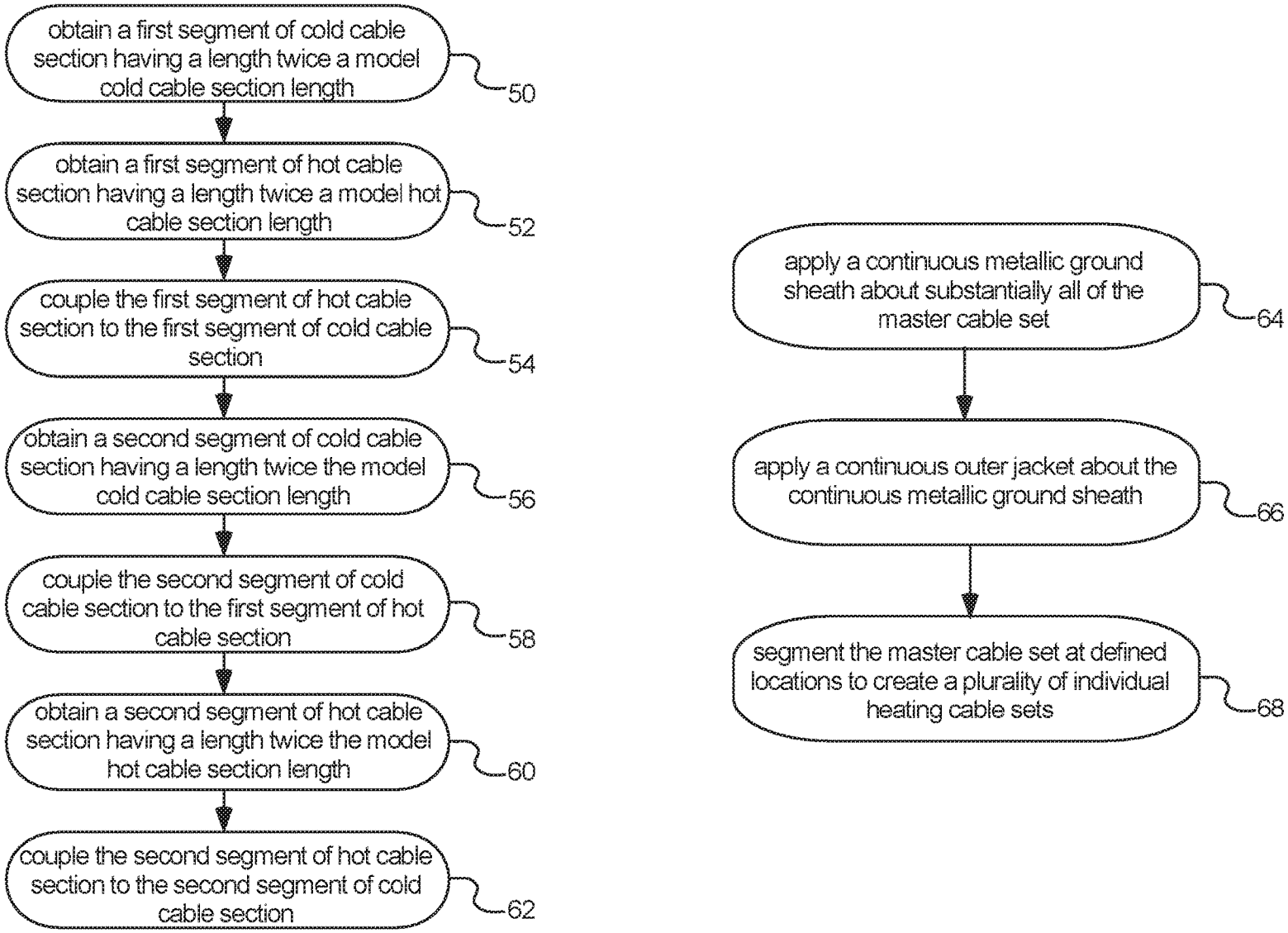
FIG. 7 is a flowchart illustrating various exemplary steps in a method of forming heating cable sets in accordance with an embodiment of the present technology.

FIG. 7 illustrates an exemplary process by which heating cable sets can be formed in accordance with the present technology. The process can include creating at least a portion of a master cable set by obtaining 50 a first segment (one of sections 32' in FIG. 6) of cold cable section having a length twice a model cold cable section length. At 52, the process can include obtaining a first segment of hot cable section (one of sections 34 in FIG. 6) having a length twice a model hot cable section length. At 54, the first segment of hot cable section and the first segment of cold cable section can be coupled one to another. At 56, the process can include obtaining a second segment of cold cable section (another of the sections 32' in FIG. 6) having a length twice the model cold cable section length. At 58 the process can include coupling the second segment of cold cable section to the first segment of hot cable section. At 60 the process can include obtaining a second segment of hot cable section (another of sections 34 in FIG. 6) having a length twice the model hot cable section length. Finally, at 62 the process can include coupling the second segment of hot cable section to the second segment of cold cable section.

This process can be repeated a number of times, depending on how many cable sections are to be combined to create the master cable. Note that the process can also include applying a cold cable section segment 32, having a length the same as the model cold cable section length, to beginning and end segments of the master cable set (or by beginning and ending with a hot cable section of model length). These initial and end sections need not be segmented later on, as they are already formed at a proper length.

After the master cable segments have been coupled to one another, the process can include at 64 applying a continuous metallic ground sheath about substantially all of the master cable set. At 66 a continuous outer jacket can be applied about the continuous metallic ground sheath. Finally, the master cable set can be segmented at defined locations to create a plurality of individual heating cable sets having an overall length of the model hot cable section length plus the model cold cable section length.

In addition to the master cable set shown in FIG. 6, the present technology can also encompass a master cable set that includes a series of hot cable sections and cold cable sections formed at the model hot and cold cable section lengths, respectively. In this example, the master cable set would be segmented only at joints between the hot and cold cable sections, to thereby create individual cable sets having an overall length of the model hot cable section length plus the model cold cable section length.

In some exemplary embodiments, the heating cable section can contain two or more conductors, and this number can represent fewer than the number of conductors used to generate heat. For example, one or more of the other conductors may be chosen to be a non-heating conductor for the sole purpose of returning the current to the cold lead cable section. Also, in some embodiments, the hot conductors of the hot cable section may include different electrical resistances: that is, they may be different sizes and/or formed from different alloys, but they still exhibit the required overall electrical resistance and overall power requirement.

Depending upon the manufacturing facilities available for any particular application, the processes of the present technology can be performed at varying locations and in varying stages. In one aspect of the invention, nearly all increments can be completed at one manufacturing location. The following exemplary methodology can be employed:

First Operations—Insulation

1) Insulating the metal alloy conductors of the heating cables (hot conductors) by the plastic tubing extrusion process and winding each on a process reel. At this point, the process provides the opportunity to choose the type of alloy, the diameter of the alloy conductor and the insulation thickness to be appropriately close enough in outer diameter to the outer diameter of the insulated cold lead conductor for when the outer jacketing operation is undertaken.
2) Insulating the copper conductors (18 AWG or 16 AWG or 14 AWG) of the cold lead cable by the plastic tubing extrusion process and winding each on a process reel.

Second Operations—Twisting

1) Twisting the insulated hot conductors using a twisting machine by unwinding two insulation process reels, feeding both wires into the machine and winding the twisted pair on another process reel.

Third Operation—Soldering

1) When beginning a process reel, first winding an appropriate length (e.g., 7 feet) of both insulated cold lead conductors in parallel at the same time on a new reel from their individual insulation reel.
2) Welding the outer end of each cold lead conductor on the new reel to the outer end of each of the twisted and insulated hot conductors taken out from the twisting machine reel, and insulating the welds using shrinkable tubing. Staggering each weld by an appropriate distance can also be done to limit the overall diameter, once the shrinkable tubing is installed.
3) Winding twice the appropriate length (according to the model, e.g., appropriate ohms/feet) of twisted and insulated hot conductors on the new reel.
4) Welding the outer end of each twisted and insulated hot conductor on the new reel to the outer end of each insulated cold lead conductor from their individual insulation reel, staggering each weld to limit the overall diameter and insulating the welds using shrinkable tubing, as described in 2) above.
5) Winding twice the appropriate length (e.g., 14 feet) of both insulated cold lead conductors in parallel at the same time on the new reel.

6) Repeating steps 2 to 5 until the new process reel is full. This method can be better than repeating single lengths of each.

Fourth Operation—Braiding

1) Unwinding the process reel from the soldering process, feeding the wires into the braiding machine to apply the tinned copper wire strands in a braid pattern, around the whole sequence of twisted and insulated hot conductors, and insulated cold lead conductors in one continuous run, to create the braided ground shield for the cable Fifth Operation—Jacketing 1) Unwinding the process reel from the braiding process, feeding the wires into the plastic extrusion line to apply the outer PVC (or other plastic) around the braided core using the tubing extrusion method in one continuous run.
2) The difference in overall size of the hot conductor section versus the cold lead section, versus the welded section prior to jacketing should be within reasonable limits to provide good processability, without obtaining extrusion cone breaks from the tubing extrusion process. As an example, the PVC tubing extrusion method for jacketing is more forgiving for variations in core diameters than is the tubing extrusion method for fluoropolymers for the insulating process.

Sixth Operation—Cutting & Spooling

1) Unwinding the process reel from the jacketing operation and cutting the cable at the appropriate locations to have 7 ft of a cold lead section and X ft of heating cable section according to the model (length) currently made.
2) For example, cutting in the middle of the 14 feet long sections, between the two slight bulges where the welds are, and at the correct length of the heating section following a slight bulge of a weld, or halfway in the heating cable section.
3) Winding each heating cable set on an individual spool.

Seventh Operation—Assembly

1) Making the end splice on the heating cable section.
2) Stripping the cold lead end to have the lead wires and the ground braid ready to be connected to the thermostat and to the junction box at the customer's location.

Eighth Operation—Final Testing & Packaging

1) Performing the electrical tests to ensure the heating cable set is continuous, at the right wattage and without short circuits.
2) Packaging the spool of heating cable sets in a box and including the appropriate labels and documents.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A method of forming a plurality of individual heating cable sets, the method comprising:

creating at least a portion of a master cable set by:

obtaining a first segment of cold cable section having a length at least a model cold cable section length;

obtaining a first segment of hot cable section having a length at least a model hot cable section length;

coupling the first segment of hot cable section to the first segment of cold cable section;

obtaining a second segment of cold cable section having a length at least the model cold cable section length;

coupling the second segment of cold cable section to the first segment of hot cable section;

obtaining a second segment of hot cable section having a length at least the model hot cable section length;

coupling the second segment of hot cable section to the second segment of cold cable section;

applying a continuous metallic ground sheath about substantially all of the master cable set;

applying a continuous outer jacket about the continuous metallic ground sheath; and segmenting the master cable set at defined locations to create a plurality of individual heating cable sets having an overall length of the model hot cable section length plus the model cold cable section length;

wherein each of the first and second segments of the hot cable section include a hot conductor having a hot conductor insulation applied thereto, and wherein each of the first and second segments of the cold cable section include a cold conductor having a cold conductor insulation applied thereto, the hot conductor and the cold conductor insulation being applied before the hot cable sections are coupled to the cold cable sections.

2. The method of claim 1, wherein:

the first segment of cold cable section has a length twice the model cold cable section length;

the first segment of hot cable section has a length twice the model hot cable section length;

the second segment of cold cable section has a length twice the model cold cable section length; and the second segment of hot cable section has a length twice the model hot cable section length.

3. The method of claim 1, further comprising varying at least one of: i) an outside diameter of the hot conductor; ii) an outside diameter of the hot conductor insulation; iii) an outside diameter of the cold conductor; and iv) an outside diameter of the cold conductor insulation to achieve a difference between the outside diameter of the hot conductor insulation and the outside diameter of the cold conductor insulation that is within a predetermined target range.

4. The method of claim 1, further comprising removing cold conductor insulation from ends of the cold cable section and removing hot conductor insulation from ends of the hot cable section of the individual heating cable sets.

5. The method of claim 1, wherein applying the continuous outer jacket comprises applying the continuous outer jacket using a tubing extrusion process.

6. The method of claim 1, wherein applying the continuous outer jacket comprises applying the continuous outer jacket using a pressure extrusion process.

7. A method of forming a plurality of individual heating cable sets, the method comprising:

creating at least a portion of a master cable set by:

obtaining a first segment of cold cable section having a length at least a model cold cable section length;

obtaining a first segment of hot cable section having a length at least a model hot cable section length;

coupling the first segment of hot cable section to the first segment of cold cable section;

obtaining a second segment of cold cable section having a length at least the model cold cable section length;

coupling the second segment of cold cable section to the first segment of hot cable section;

obtaining a second segment of hot cable section having a length at least the model hot cable section length;

coupling the second segment of hot cable section to the second segment of cold cable section;

applying a continuous metallic ground sheath about substantially all of the master cable set;

applying a continuous outer jacket about the continuous metallic ground sheath; and segmenting the master cable set at defined locations to create a plurality of individual heating cable sets having an overall length of the model hot cable section length plus the model cold cable section length; wherein the first segment of cold cable section has a length twice the model cold cable section length;

the first segment of hot cable section has a length twice the model hot cable section length;

the second segment of cold cable section has a length twice the model cold cable section length; and the second segment of hot cable section has a length twice the model hot cable section length.

8. The method of claim 7, wherein each of the first and second segments of the hot cable section include a hot conductor having a hot conductor insulation applied thereto, and wherein each of the first and second segments of the cold cable section include a cold conductor having a cold conductor insulation applied thereto, the hot conductor and the cold conductor insulation being applied before the hot cable sections are coupled to the cold cable sections.

9. The method of claim 7, further comprising varying at least one of: i) an outside diameter of the hot conductor; ii) an outside diameter of the hot conductor insulation; iii) an outside diameter of the cold conductor; and iv) an outside diameter of the cold conductor insulation to achieve a difference between the outside diameter of the hot conductor insulation and the outside diameter of the cold conductor insulation that is within a predetermined target range.

10. The method of claim 7, further comprising removing cold conductor insulation from ends of the cold cable section and removing hot conductor insulation from ends of the hot cable section of the individual heating cable sets.

11. The method of claim 7, wherein applying the continuous outer jacket comprises applying the continuous outer jacket using a tubing extrusion process.

12. The method of claim 7, wherein applying the continuous outer jacket comprises applying the continuous outer jacket using a pressure extrusion process.

* * * * *